United States Patent [19]

Gustafson et al.

[11] Patent Number: 5,011,700

[45] Date of Patent: Apr. 30, 1991

[54] SYRUP DELIVERY SYSTEM FOR CARBONATED BEVERAGES

[76] Inventors: Keith W. Gustafson, Station 1101, Lake Arrowhead, Waleska, Ga. 30183; George W. Kalet, 2892 Wynfair Dr., Marietta, Ga. 30062; Martin S. Taylor, Station 1083, Lake Arrowhead, Waleska, Ga. 30183

[21] Appl. No.: 392,779

[22] Filed: Aug. 11, 1989

[51] Int. Cl.[5] ..... B01F 3/04

[52] U.S. Cl. ..... 426/477; 99/275; 261/DIG. 7; 366/150; 426/590

[58] Field of Search ..... 366/150, 184; 99/275, 99/323.1, 323.3; 222/95, 386.5; 426/590, 477; 261/DIG. 7, DIG. 65

[56] References Cited

U.S. PATENT DOCUMENTS 2,391,003 12/1945 Bowman ..... 261/DIG. 7
3,371,822 3/1968 Galloway ..... 222/95
4,304,736 12/1981 McMillin ..... 261/DIG. 7

*Primary Examiner*—Robert W. Jenkins
*Attorney, Agent, or Firm*—Jones, Askew & Lunsford

[57] ABSTRACT

There is disclosed a syrup delivery system for carbonated beverages which provides delivery of beverage syrup from a syrup container to a beverage mixer. The syrup delivery system comprises a source of pressurized gas, conveniently the $CO_2$ gas source which is also used to carbonate the water used to mix the carbonated beverage, and a syrup container. The syrup container comprises a rigid drum having an opening with a closure and a pressurizing fitting for connection to the source of presurized gas. A collapsible bag for holding the syrup is fitted inside of the rigid drum and is connected by means of a double ended connector through the closure to the beverage mixer. In operation, the $CO_2$ pressurized gas is introduced into the rigid tank between the inside of the tank and the outside of the collapsible bag thereby forcing the syrup out of the bag and to the beverage mixer at a constant pressure. Because the closure is a standard size to fit existing small and large syrup containers, the syrup deliver system can be retrofitted into existing bulk on-premises syrup containers as well as retrofitted into smaller existing syrup containers. In both cases, the need to clean and sanitize the syrup containers is eliminated.

9 Claims, 5 Drawing Sheets

127
128
150
TO CARBONATOR
172
152
166
154
134
124
125
116
168
24
174
176
158
160
156
170
30
162
132
112
114
122
12
TO SYRUP CONTAINER
120
164
118

SYRUP DELIVERY SYSTEM FOR CARBONATED BEVERAGES

BACKGROUND OF THE INVENTION

The present invention relates generally to a carbonated beverage system for mixing carbonated beverages at the time of service (post mix), and more particularly concerns a syrup delivery system for delivering the beverage syrup to a carbonated beverage mixer where the syrup is mixed with carbonated water.

In the fountain, restaurant, and fast food industry, where high volumes of carbonated beverages are served to customers, it is customary to carbonate water with a source of $CO_2$ gas and then mix the carbonated water and beverage syrup at a beverage mixer or mixing valve just prior to delivery to the customer. In one common post mix carbonated beverage system, the syrup is delivered to the fast food outlet in syrup containers comprising five gallon steel drums. The syrup is drawn from the steel drum by pressurizing the drum with a pressurizing gas and thereby forcing the syrup out of the drum through a drop tube in the drum. In restaurants that dispense very high volumes of carbonated beverages, the syrup may be delivered in bulk to the restaurant and stored in large (75 gallon) permanently installed syrup drums. In the case of the permanently installed syrup drums, the syrup is delivered from the syrup drum to the beverage mixer by pressurizing the large drum to force the syrup out through a drop tube just like the smaller five gallon syrup drums. In both cases it is necessary to clean and sanitize the syrup drums after use and before refilling. In the case of the smaller five gallon drums, the drums are returned to the syrup vendor who cleans, sanitizes, and refills the drums before redelivery. In the case of the large permanently installed syrup drums, it is necessary to have a permanently installed, on-premise cleaning and sanitizing system for the syrup drums. In addition it is necessary to have at least two large syrup drums so that while one is being cleaned, the other can provide syrup for the continuing operation of the beverage mixer. Typically, three drums are installed on-premise so that at any given time, one is in use, one is in reserve, and one is being cleaned or awaiting bulk syrup delivery. Similarly for the smaller five gallon drums, the syrup vendor must have a sufficient number of drums available to compensate for those that are being cleaned at any point in time.

In another syrup delivery system, the syrup is delivered to restaurants in a syrup container called a bag in a box. The bag in a box container consists of a plastic bag inside a cardboard box. The plastic bag has a connector which can be attached to the beverage mixer for delivery of the syrup from the plastic bag to the beverage mixer. The bag in a box system requires an auxiliary pump which creates a partial vacuum to suck the syrup out of the plastic bag. The requirement of an auxiliary pump introduces not only an additional capital cost to the system, but also an additional variable into the beverage mixing process. If the auxiliary pump does not deliver the syrup to the beverage mixer at the correct pressure, the resulting beverage will not be up to the desired quality standard. Even minor variations in the final beverage mix can produce significant variations in the taste of the resulting carbonated beverage. Moreover, the bag in a box container does not appear to be practically adaptable to a very high volume, on-premise bulk syrup storage and delivery system.

In addition to post mix carbonated beverage systems, there is also the need in bars and restaurants to deliver beverages such as wines from a bulk storage container to a dispenser and then by the glass to a customer. If wine, for example, is delivered to a restaurant in a drum, the drum cannot be pressurized with $CO_2$ gas because such a procedure would carbonate the wine. An auxiliary suction pump will empty the wine from the drum, but that requires additional equipment with the attendant problems. Moreover, in order to reuse a bulk storage container for a beverage such as wine it would be necessary to clean and sanitize such container before reuse.

SUMMARY OF THE INVENTION

It is therefore an object of the present invention to provide a syrup delivery system for a carbonated beverage system which eliminates the necessity of cleaning and sanitizing the syrup containers after use but does not require additional auxiliary pumps.

It is also an object of the present invention to provide a syrup delivery system for a carbonated beverage system which eliminates the necessity of cleaning and sanitizing the syrup containers after use and can be adapted for use with very high volume carbonated beverage systems.

It is also an object of the present invention to provide a syrup delivery system for a carbonated beverage system which eliminates the necessity of cleaning and sanitizing the syrup containers after use and can be retrofitted for use with existing very high volume carbonated beverage systems.

It is additionally an object of the present invention to provide a beverage delivery system for delivering beverages from a beverage container to a beverage dispenser without using a suction pump or without contaminating the beverage.

In order to achieve the foregoing objectives, the syrup delivery system of the present invention comprises a source of pressurizing gas, conveniently the $CO_2$ gas source used to carbonate the water for the carbonated beverage, and a syrup container which is a rigid drum with a plastic bag located inside of the rigid drum. The rigid drum has an elliptical top opening which accommodates an elliptical pressure seal closure. The closure, when in place, provides a pressure seal for the opening. The closure also includes a double ended connector means having an internal male bag connector and an external quick disconnect connector for attachment to a delivery line leading to the beverage mixer. The plastic bag has a female bag connector which is adaptable for attachment to the internal male bag connector. The rigid drum also has a pressurizing fitting for introducing pressurizing gas from the existing $CO_2$ tank into the space between the plastic bag and the inside of the rigid drum. The syrup in the plastic bag inside the rigid drum is delivered to the beverage mixer by connecting the pressurizing fitting on the rigid drum to the source of pressurizing gas and pressurizing the space between the plastic bag and the rigid drum.

The present syrup delivery system enjoys several advantages over existing syrup delivery systems. In contrast to the existing steel drum (large or small), there is no necessity to clean and sanitize the system of the present invention. After the syrup has been used, the closure and the plastic bag are removed from the rigid drum, the plastic bag is disconnected from the male bag connector of the closure and discarded, and a new presanitized plastic bag is installed. Even for the large on-premise drums, the cost of the replacement or reuseable plastic bag is small compared to the cost of the cleaning and sanitizing system and the additional storage drums needed while the other drums are being cleaned and sanitized. Moreover, by providing a closure with a double ended connector in accordance with the present invention having a standard external quick disconnect connector, the syrup delivery system of the present invention can be retrofitted to upgrade existing on-premise syrup storage drums without further modification of the system except for elimination of the cleaning system and the time lost during such cleaning.

In contrast to the bag in a box system, the present invention eliminates the need for an auxiliary pump to suck the syrup out of the bag. In addition, the delivery flow pressure in the present invention is produced by the existing $CO_2$ gas source and can be controlled more accurately thereby resulting in a more consistent mix and taste. The syrup delivery system of the present invention also provides a system that does not require cleaning and sanitizing but does not produce even a fraction of the volume of trash resulting from using a bag in a box system. Particularly, a single empty 75 gallon plastic bag represents the volume of trash generated by the present syrup delivery system as compared to 15 cardboard boxes for the bag in a box system. Moreover, the syrup delivery system of the present invention with its rigid drum is not as prone to damage and loss as the cardboard container used in the bag in a box system.

The present invention also envisions a beverage delivery system for delivery of a beverage from a bulk storage container to a beverage dispenser. Particularly, the beverage delivery system uses a collapsible bag in a rigid drum similar to the syrup delivery system. The collapsible bag contains the beverage and provides a barrier between the pressurizing gas and the beverage in the bulk storage container in order to eliminate contamination of the beverage, such as $CO_2$ carbonating wine. Therefore in a restaurant, the same source of $CO_2$ gas used to carbonate the carbonated beverages in a post mix system can be used to dispense beverages without imparting undesired carbonation to those beverages. Moreover, the bag can be removed when empty and discarded thereby eliminating the need to clean and sanitize the bulk storage container before reuse.

Other objects and advantages of the invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and the scope of the invention as defined by the appended claims.

Figure 1:
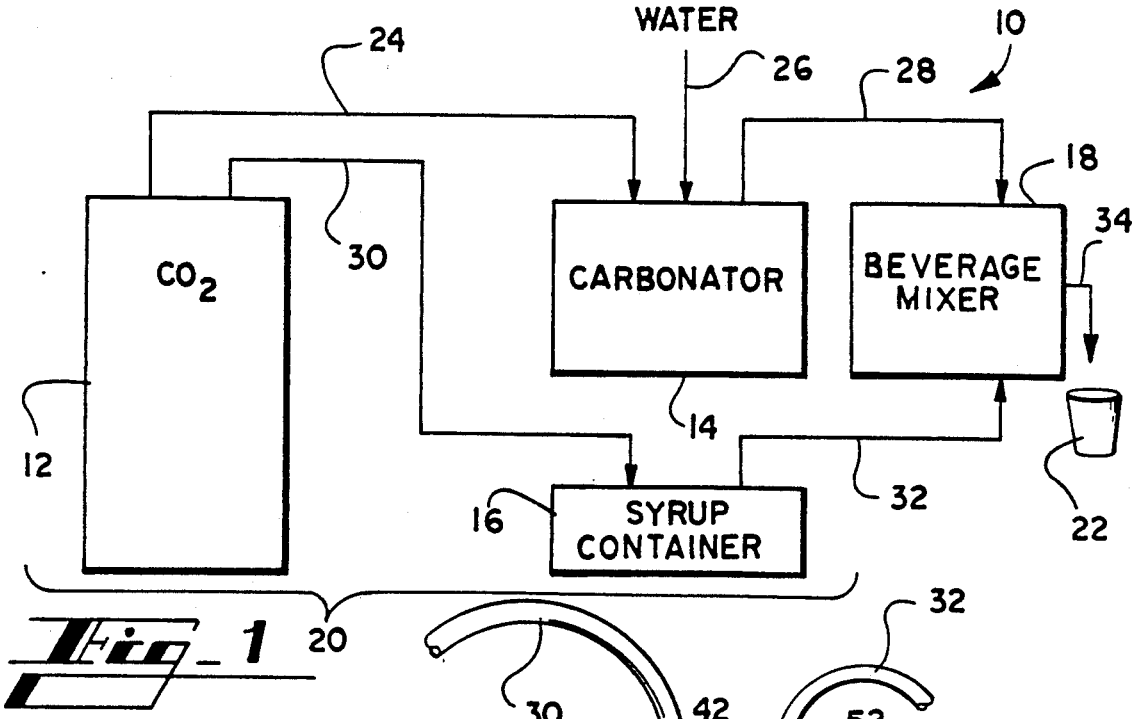
FIG. 1 is a schematic diagram showing the syrup delivery system of the present invention.

Turning to FIG. 1, there is shown schematically a carbonated beverage system 10 comprising a source of pressurizing fluid 12, preferably a liquid $CO_2$ tank, a carbonator 14, a syrup container 16, and a beverage mixer or mixing valve 18. Together the source of pressurizing gas 12 and the syrup container 16 provide a syrup delivery system 20 in accordance with the present invention.

In the carbonated beverage system 10, $CO_2$ gas is delivered under pressure of 60 pounds per square inch (psi) from the $CO_2$ tank 12 via line 24 to the carbonator 14. The carbonator 14 mixes the $CO_2$ gas with filtered water from water line 26 in conventional fashion to produce carbonated water in carbonated water line 28. The carbonated water in line 28 is delivered to the beverage mixer 18 where it is mixed in conventional fashion with the beverage syrup. The resulting carbonated beverage is delivered through line 34 into a cup 22 at the restaurant or retail outlet.

In order to deliver the syrup in syrup container 16 to the beverage mixer 18, the syrup delivery system 20 utilizes the $CO_2$ tank 12 to provide pressurized $CO_2$ gas in gas pressure line 30 at a pressure of 60 psi to the syrup container 16. Any other source of clean pressurized fluid, either gas or liquid, could be employed, such as compressed nitrogen, oxygen, air, or water under pressure. The source of pressurized fluid is preferably a cryogenic liquid $CO_2$ tank which can provide $CO_2$ gas for the carbonator 14 as well as for the syrup delivery system 20. As will be subsequently explained, the pressurized $CO_2$ gas in line 30 forces the syrup out of the syrup container 16 through syrup delivery line 32 to the beverage mixer 18.

Figure 4:
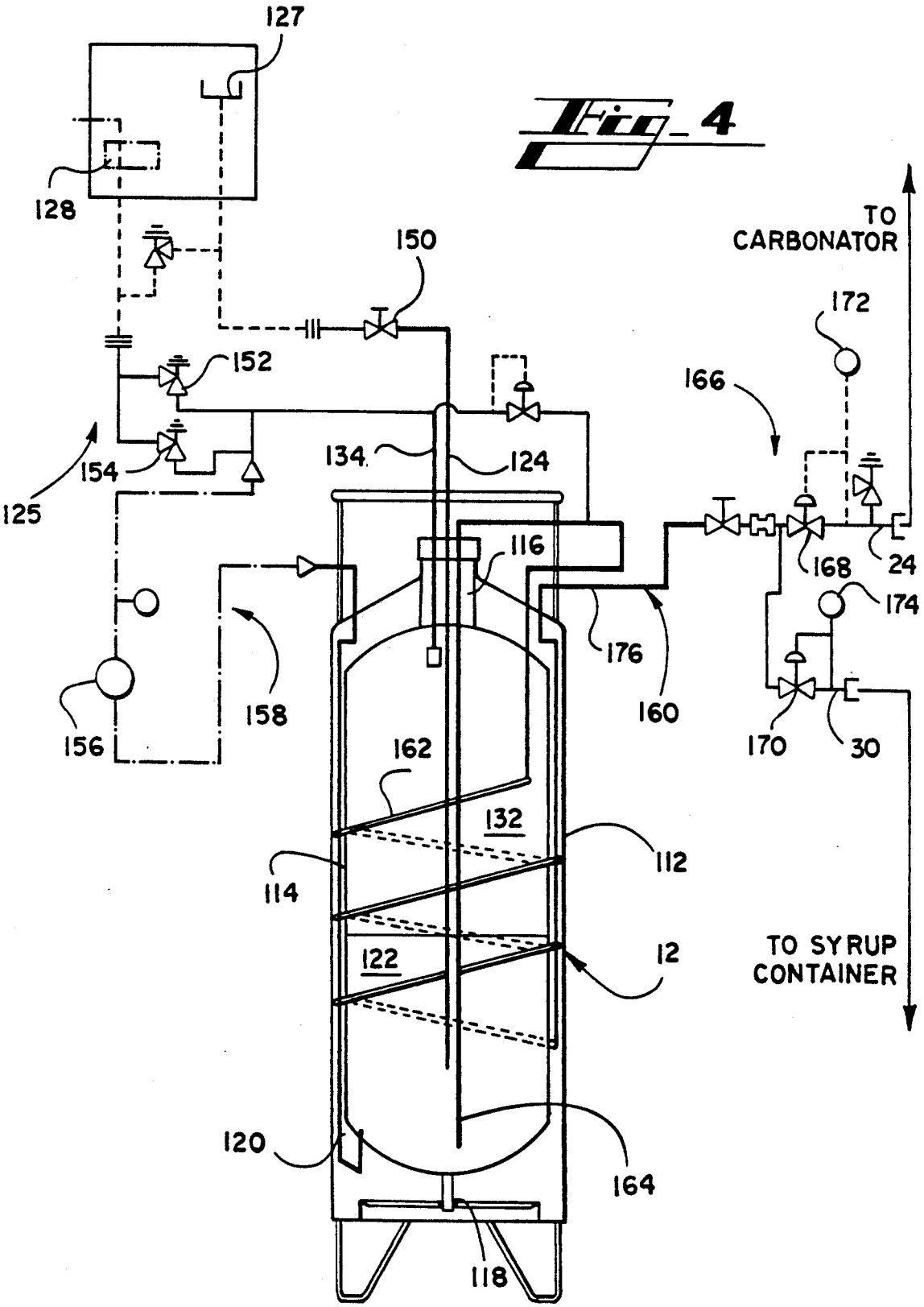
FIG. 4 is an is a schematic diagram showing a liquid $CO_2$ tank for supplying $CO_2$ gas for use in connection with the syrup delivery system of the present invention.

Turning to FIG. 4, the $CO_2$ tank 12 is preferably a cryogenic liquid $CO_2$ tank having an outer vessel 112 and an inner vessel 114. The inner vessel is suspended within the outer vessel by means of a neck 116 and a base support 118. An insulating space 120 located between the inner vessel and the outer vessel is evacuated to create a vacuum and is insulated thereby minimizing the amount of heat transfer from the ambient atmosphere outside of the tank 12 to the contents of the inner vessel 114. The inner vessel 114 contains liquified $CO_2$ gas in the liquid phase 122 with a vapor phase 132 disposed above the liquid 122.

The neck 116 provides a sealable port from outside of the $CO_2$ tank 12 to the inside of inner vessel 114. A filler pipe 124 for filling vessel 114 extends through the neck 116. The filler pipe 124 is connected to a self-closing coupling 127 with an intermediate shut off valve 150. A pressure relief means 125 includes a vent tube 134 which extends through the neck 116, primary and secondary reliefs 152 and 154 respectively, and exhaust port 128. The $CO_2$ tank 12 may also conveniently include a conventional liquid level gauge 156 and associated connections 158 for providing a visual indication of the level of the liquid $CO_2$ 122 in the inner vessel 114.

In accordance with the present invention the $CO_2$ tank 12 also has a liquid vaporization circuitry 160 to produce $CO_2$ gas under pressure to the carbonator 14 and the syrup delivery system 16 via line 24 and gas pressure line 30 respectively. The liquid vaporization circuitry 160 comprises evaporator coils 162 disposed in the vacuum space 120, drop tube 164, and output regulator means 166. The regulator means 166 further comprises carbonator regulator 168 connected between the evaporator coils 162 and the line 24 to the carbonator 14 and syrup regulator 170 connected between the evaporator coils 162 and the gas pressure line 30 to the syrup container 16. Pressure gauges 172 for the carbonator line 24 and 174 for the syrup gas pressure line 30 provide a visual indication of the gas pressure being delivered to the carbonator and the syrup container, respectively. The pressure regulators 168 and 170 when set can provide $CO_2$ gas to the carbonator and syrup container at a substantially constant pressure.

In operation, the vapor pressure in the vapor space 132 above the liquid $CO_2$ forces the liquid up through the drop tube 164 and into the evaporator coils 162. Because the coils 162 are attached to the outer vessel 112, they absorb heat from the ambient atmosphere outside the tank 12, and the liquid $CO_2$ in the coils evaporates and provides gas in line 176 which in turn is connected to the regulator means 166 and to the lines 24 and 30. The $CO_2$ gas in gas pressure line 30 in connection with the present invention serves to force the syrup in container 16 from the syrup container through syrup delivery line 32 to the beverage mixer 18.

Figure 2:
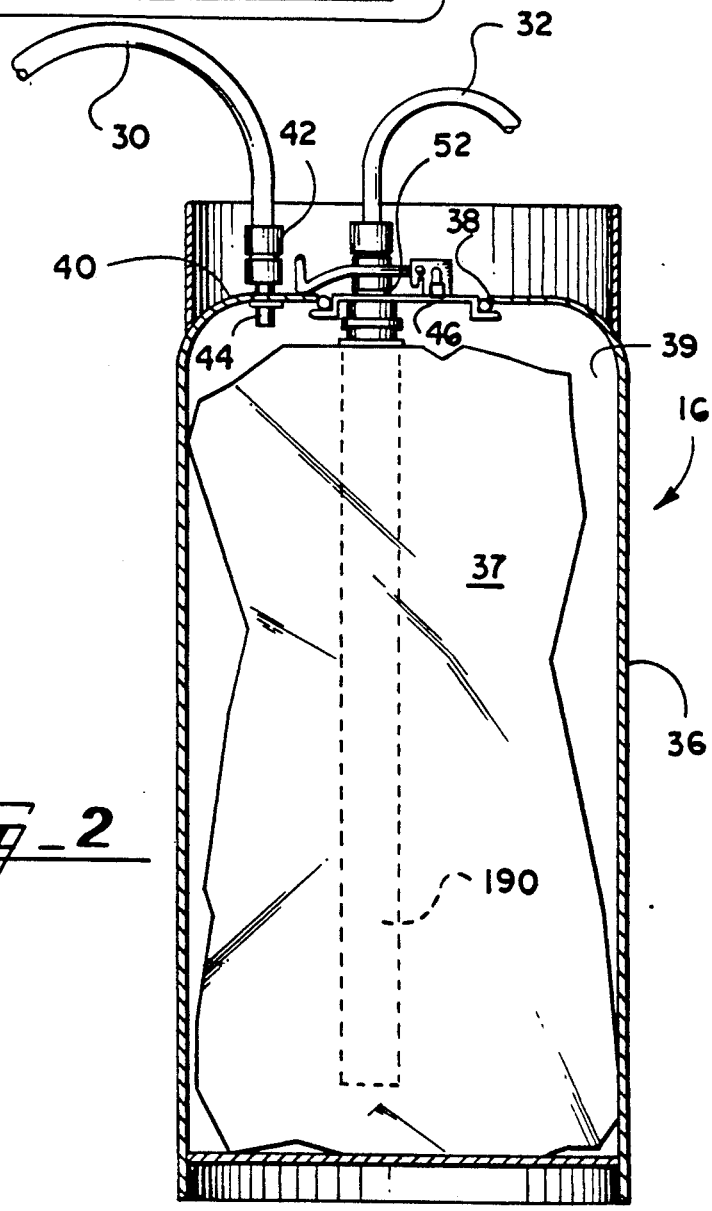
FIG. 2 is an is an elevation view, partly in vertical cross-section showing a small five gallon syrup container with an internal collapsible bag of the present invention.

Turning to FIG. 2, there is shown in greater detail the syrup container 16 which in FIG. 2 is a five gallon syrup container. The syrup container 16 comprises a rigid drum 36 with a collapsible bag 37 inside. The rigid drum 36 has an elliptical opening 38 in its top 40. There is also a quick release fitting 42 in the top 40 of the tank which includes a short tube 44 extending through the top 40 providing access to the interior of the rigid drum 36 between the rigid drum 36 and the plastic bag 37. The fitting 42 is connected to the gas pressure line 30 from the $CO_2$ tank 12 in order to provide pressurizing gas to the interior of the rigid drum 36 in a space 39 between the rigid drum 36 and the plastic bag 37. The fitting 42 and connection of pressure line 30 is conventional.

Figure 5:
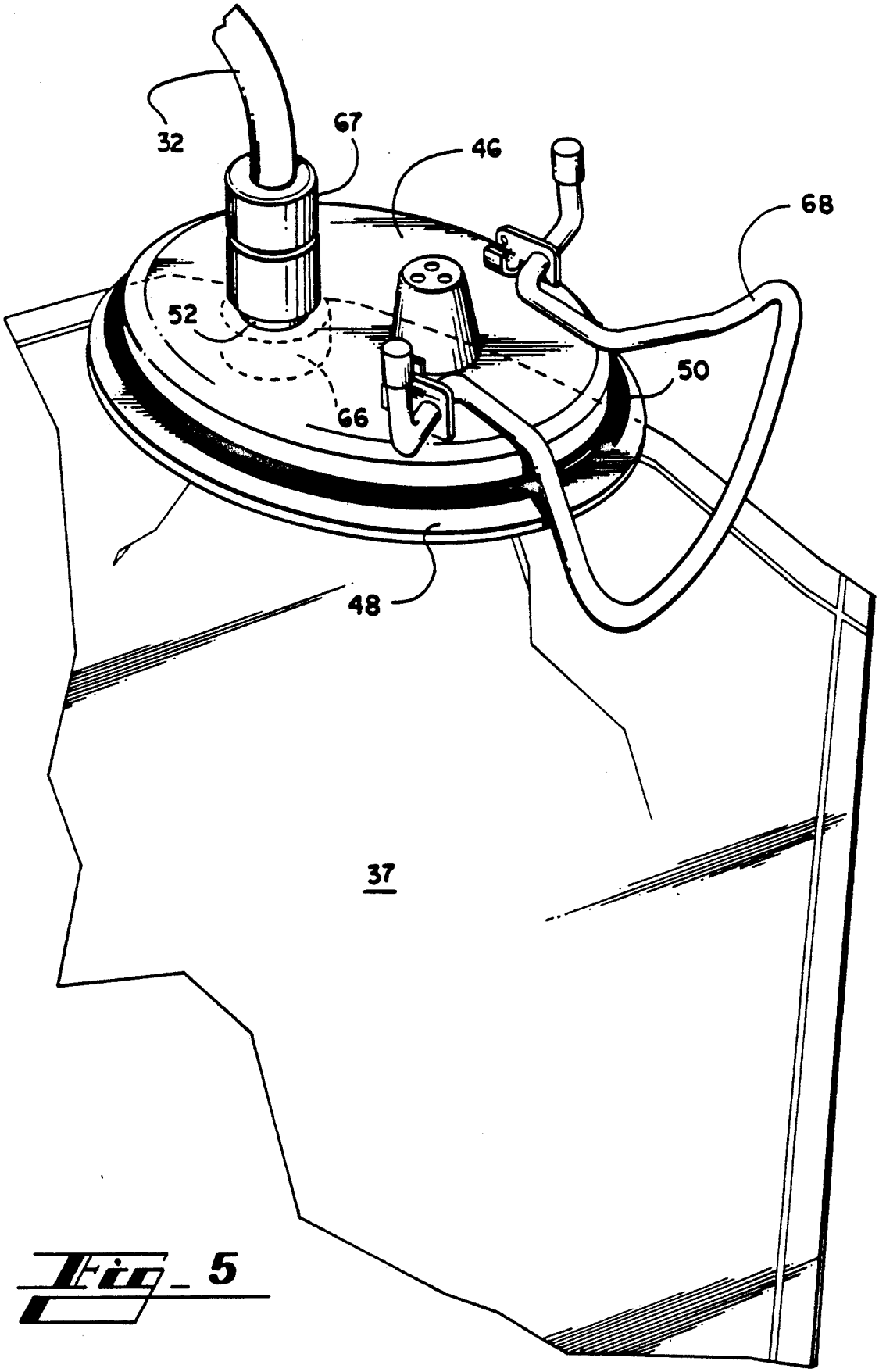
FIG. 5 is a detailed perspective view of the elliptical closure showing the double ended connector for attachment of the collapsible bag to the closure and for providing an outlet port for delivery of the syrup in the bag to the beverage mixer.
Figure 6:
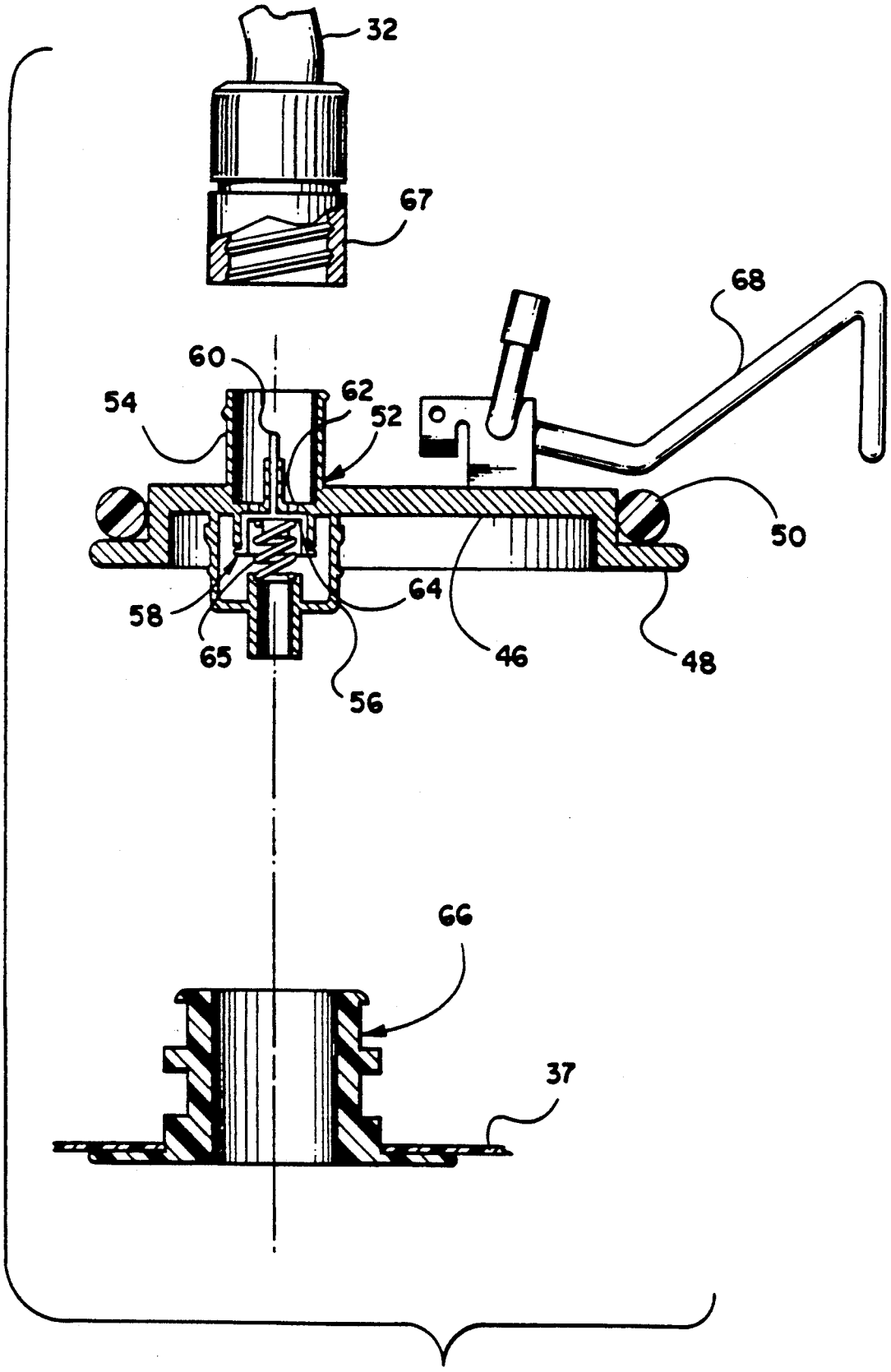
FIG. 6 is a detailed section view of the elliptical closure showing the double ended connector for attachment of the collapsible bag to the closure and for providing an outlet port for delivery of the syrup in the bag to the beverage mixer.

The elliptical opening 38 is closed and sealed by means of an elliptical closure 46 which is shown in greater detail in FIGS. 5 and 6. The elliptical closure 46 is preferred because such a closure is compatible with existing syrup containers although any suitable removable pressure sealing closure may be employed. The elliptical closure has a sealing flange 48 with an O-ring 50 disposed around the periphery of the elliptical closure 46. The elliptical closure 46 also includes double ended connector means 52 which comprises a external quick disconnect coupling 54 and an internal male bag connector 56. The double ended connector means 52 also includes valve means 58 which comprises a valve stem 60, inlet/outlet holes 62, and movable member 64 which is connected to stem 60 and urged into contact with the hole 62 by means of spring 65. The valve means serves to open a path through the double ended connector means 52 when line 32 is connected by means of connector cap 67 to the external quick disconnect coupling 54 and to seal off the the double ended connector means 52 when the line 32 is disconnected. Because the elliptical closure 46 will fit the standard sized opening 38 of conventional five gallon or seventy-five gallon syrup containers, the elliptical closure 46 is simply inserted into the elliptical opening 38 (FIG. 2) in the top of the rigid drum 36, rotated 90°, and then pulled upward and into engagement with the opening 38 by means of the lever 68.

The collapsible bag 37 includes a female bag connector 66 that is adaptable for engagement with internal male bag connector 56. In the preferred embodiment, the two connectors 56 and 66 are sized so that they simply snap together to provide a sealed connection between the bag 37 and the double ended connector means 52. While a simple snap-together connection such as illustrated in FIG. 6 is thought to be preferred, any liquid tight connector, such as a threaded or a bayonet connector, that is easily connected and disconnected may be used to connect the collapsible bag to the double ended connector means 52. The illustrated snap-together connector is similar in construction to that used in connection with the prior art bag in a box syrup container.

Figure 3:
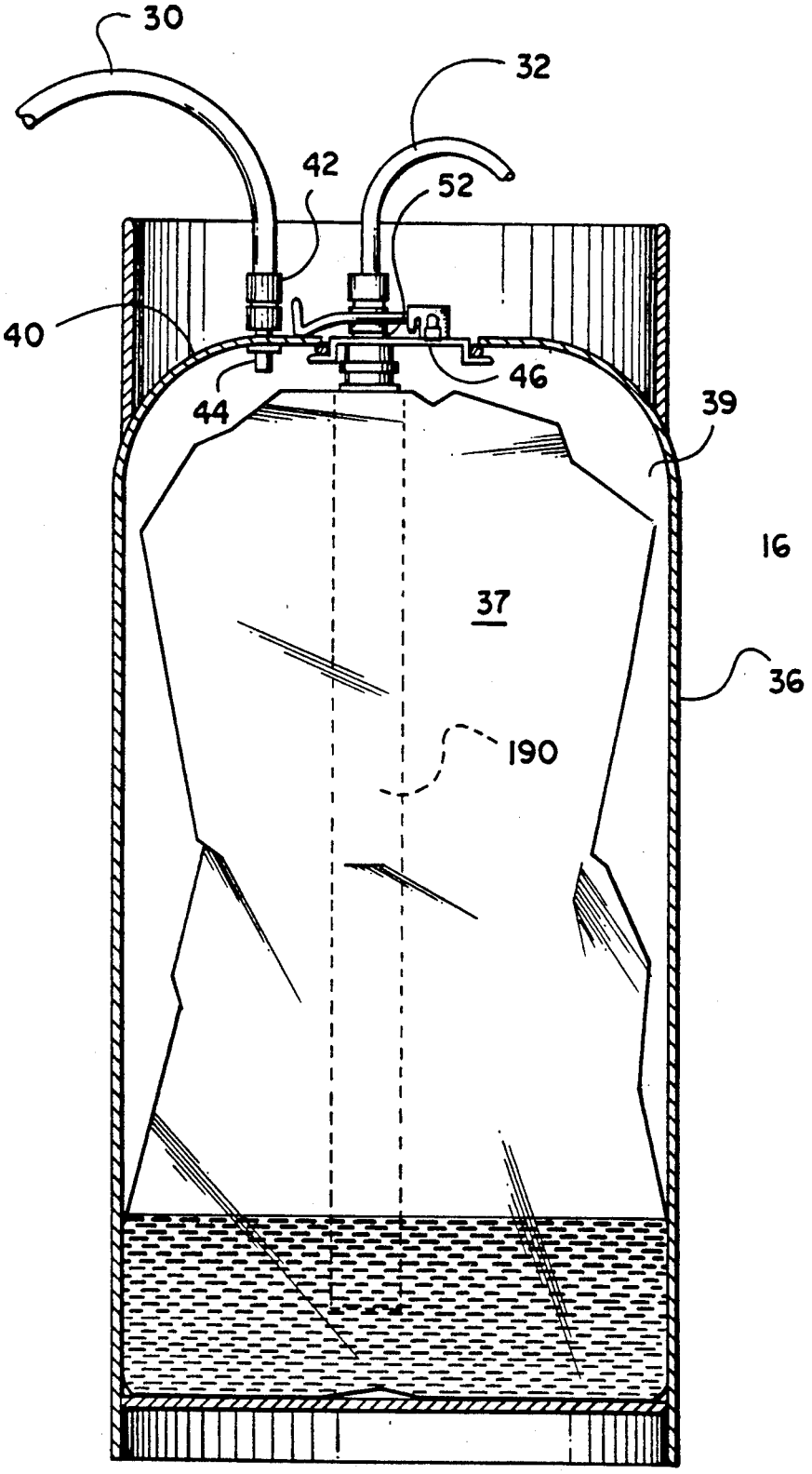
FIG. 3 is an is an elevation view, partly in vertical cross-section showing a large on-premise syrup container with an internal collapsible bag of the present invention.

Turning to FIG. 3, there is illustrated a larger seventy-five gallon tank which unlike the smaller five gallon tank shown in FIG. 2 is permanently installed on the premise of the carbonated beverage retailer and filled from a bulk supply. The elliptical closure 46 with its double ended connector means 52 used on the seventy-five gallon tank is the same as the elliptical closure 46 used with the smaller five gallon syrup tank 16. The collapsible bag 37 is installed in the rigid drum 36 and the gas pressure line 30 and the syrup delivery line 32 are connected in exactly the same fashion as described in connection with the smaller syrup tank shown in FIG. 2. The only difference is in the size and capacity of the collapsible bag 37. Consequently, it can be seen that by simply providing the elliptical closure 46 of the present invention along with the the properly sized plastic bag 37, an existing on-premises seventy-five gallon tank, such as that shown in FIG. 3, can be retrofitted to incorporate the syrup delivery system of the present invention.

In operation, the syrup delivery system 20 of the present invention delivers syrup from the syrup container 16 to the beverage mixer 18 at a constant pressure for mixing with the carbonated water. The pressurizing gas from the $CO_2$ tank 12 is introduced into the space 39 between the rigid drum 36 and the collapsible bag 37 and squeezes the bag thereby forcing the beverage syrup out of the bag 37, through the double ended connector means 52, through the syrup delivery line 32, and to the beverage mixer 18. Because the gas pressure in gas pressure line 30 can be accurately regulated, the pressure of the syrup in the syrup delivery line 32 can be maintained at a controlled constant pressure thereby assuring good quality control over the final carbonated beverage delivered to the customer in cup 22.

Because of the rigid drum 36 and the constant gas pressure on the collapsible bag 37, the bag 37 can be emptied almost completely without significant waste. A channeled strip 190 is provided in the bag 37 to assist in the complete emptying of the bag by directing the flow of the syrup toward the bag connector 66. The channeled strip 190 is connected at one end to the bag connector 66 and the other end extends toward the bottom of the bag 37. The strip has longitudinal grooves along its length which serve as channels for the syrup flowing toward the bag connector 66.

Once the bag 37 has been emptied, the quick release fitting 42 is disconnected from line 30 to release the pressure in the rigid drum 36, the elliptical closure 46 is opened, and the closure 46 and empty bag 37 are removed. The empty bag 37 is disconnected from the closure 46 and discarded, and a new presanitized bag is connected to the closure's bag connector. The new bag is inserted into the rigid drum 36 through opening 38, and the elliptical closure 46 is reinstalled in the opening 38. The new bag is then filled with syrup through double ended connector means 52 which has been attached to a bulk supply of beverage syrup. Thus the necessity of cleaning and sanitizing the syrup container is eliminated.

Returning to FIG. 2 the container 16 shown therein can also be used as part of a beverage delivery system for delivering a beverage contained in the collapsible bag 37 to a beverage dispenser (not shown). The rigid drum 36 is pressurized from a source of pressurizing fluid thereby collapsing the bag 37 and forcing the beverage therein out of the double ended connector means 52, through line 32, and to the beverage dispenser (not shown). Because of the collapsible bag, the pressurizing fluid cannot contact and contaminate the beverage. Moreover, the container 16 can also be refilled without cleaning to sanitizing by simply removing the empty collapsible bag and replacing it with a new, presanitized collapsible bag.

We claim:

1. In a carbonate beverage system comprising a source of carbonated water and a beverage mixer, a syrup delivery system for delivering beverage syrup to the beverage mixer comprising:

(a) a source of pressurizing fluid;

(b) a rigid drum having an opening with a closure and a pressurizing fitting for connection to the source of pressurizing fluid; and (c) a collapsible bag for holding syrup which bag is located inside the rigid drum and which has connector means attached to it, which connector means extends through the sealable opening of the drum for attachment to a beverage mixer, wherein the fitting on the rigid drum communicates with a space between the collapsible bag and the rigid drum so that the pressurizing fluid causes the bag to collapse under pressure of the pressurizing fluid thereby forcing the syrup in the bag out of the connector means and to the beverage mixer.

2. The syrup delivery system of claim 1, wherein the connector means comprises double ended connector means extending through the closure with an internal connector on the closure's inside for releaseable connection to a mating connector on the collapsible bag.

3. The syrup delivery system of claim 2, wherein the double ended connector means further comprises a pressure holding external coupling for releaseable connection to a line from the beverage mixer, wherein the coupling is in a sealed condition when disconnected from the line from the beverage mixer and is in an unsealed condition when connected to the line from the beverage mixer.

4. A syrup container for a post mix carbonated beverage system comprising:

(a) a rigid drum having a sealable opening with a closure and a pressurizing fitting for connection to a source of pressurizing fluid; and (b) a collapsible bag for holding syrup which bag is located inside the rigid drum and has mating connector means attached to it; and (c) a double ended connector means extending through the closure of the rigid drum with an internal connector on the closure's inside for releasable connection to the mating connector on the collapsible bag and external coupling for releasable connection to a line from the beverage mixer, wherein the external coupling is in a sealed condition when disconnected from the line from the beverage mixer and is in an unsealed condition when connected to the line from the beverage mixer, wherein the fitting on the rigid drum communicates with a space between the collapsible bag and the rigid drum so that the pressurizing fluid causes the bag to collapse under pressure of the pressurizing fluid thereby forcing the syrup in the bag out of the connector and to the beverage mixer.

5. The syrup container of claim 4 wherein the collapsible bag further comprises a channeled strip inside the bag, wherein the channeled strip directs flow in the bag toward the mating connector of the bag.

6. A method for mixing a carbonate beverage comprising the steps of:

(a) carbonating water with a source of $CO_2$ gas;

(b) delivering the carbonated water to a beverage mixer through a carbonated water inlet line;

(c) delivering beverage syrup to the beverage mixer through a syrup inlet line by:

i. connecting the syrup inlet line of the beverage mixer to a syrup container comprising a collapsible bag containing the syrup which bag is located inside a rigid drum and which bag has connector means for connection to the syrup inlet line; and ii. connecting an outlet line from a source of pressurizing fluid to a fitting on the rigid drum which fitting communicates with a space between the rigid drum and the collapsible bag so that the source of pressurizing fluid collapses the bag and forces the syrup out of the bag, through the connector means, through the syrup inlet line, and into the beverage mixer.

7. The method of claim 6, wherein the syrup container is refilled after the collapsible bag is removed from the rigid drum, disconnected from the connector means, and replace with a presanitized replacement collapsible bag.

8. A beverage delivery system for delivering a beverage from a beverage container to a beverage dispenser comprising:

(a) a source of pressurizing fluid;

(b) a rigid drum having an opening with a closure and a pressurizing fitting for connection to the source of pressurizing fluid; and (c) a collapsible bag for holding the beverage which bag is located inside the rigid drum and which bag has mating connector means attached to it; and (d) a double ended connector means extending through the closure of the rigid drum with an internal connector on the closure's inside for releasable connection to the mating connector on the collapsible bag and external coupling for releasable connection to a line from the beverage mixer, wherein the external coupling is in a sealed condition when disconnected from the line from the beverage mixer and is in an unsealed condition when connected to the line from the beverage mixer;

wherein the fitting on the rigid drum communicates with a space between the collapsible bag and the rigid drum so that the pressurizing fluid causes the bag to collapse under pressure of the pressurizing fluid thereby forcing the beverage in the bag out of the connector means and to the beverage dispenser.

9. The beverage delivery system of claim 8 wherein the collapsible bag further comprises a channeled strip inside the bag, wherein the channeled strip directs flow in the bag toward the mating connector of the bag.

* * * * *